US007222988B2

(12) United States Patent
Gober

(10) Patent No.: US 7,222,988 B2
(45) Date of Patent: May 29, 2007

(54) DISPLAY DEVICE FOR ILLUMINATING OPTICAL STORAGE DISKS FOR VISUAL DISPLAY AND METHOD OF USING THE SAME

(76) Inventor: David A. Gober, 12 Nelson Court Cir., Apt. 207, Eureka, MO (US) 63025

( * ) Notice: Subject to any disclaimer, the term of this patent is extended or adjusted under 35 U.S.C. 154(b) by 47 days.

(21) Appl. No.: 10/946,158

(22) Filed: Sep. 21, 2004

(65) Prior Publication Data

US 2006/0062002 A1 Mar. 23, 2006

(51) Int. Cl.
*F21V 14/00* (2006.01)

(52) U.S. Cl. ..... 362/257; 362/304; 362/293; 362/343; 362/811; 362/800

(58) Field of Classification Search ..... 362/257, 362/304, 293, 343, 811, 555, 800, 838, 567, 362/558, 572; 359/838, 567, 558, 572
See application file for complete search history.

(56) References Cited

U.S. PATENT DOCUMENTS 2,831,963 A 4/1958 Kurianski
3,000,774 A 9/1961 Swedlow, et al.
4,549,250 A 10/1985 Spector
5,272,610 A 12/1993 Namenye et al.
5,575,098 A 11/1996 Goettel-Schwartz
5,622,424 A 4/1997 Brady
5,692,826 A 12/1997 Hsien-Jung
5,772,314 A 6/1998 Brumer
6,312,142 B1 * 11/2001 Dorsa ..... 362/257
6,449,887 B1 * 9/2002 Song ..... 40/406
6,513,951 B1 * 2/2003 Wang et al. ..... 362/253
6,601,964 B2 * 8/2003 Wang et al. ..... 362/84
6,854,863 B2 * 2/2005 Wu ..... 362/292
6,863,411 B2 * 3/2005 Furuya ..... 362/23
6,958,869 B2 * 10/2005 Monastiere ..... 359/819

* cited by examiner

*Primary Examiner*—Jong-Suk (James) Lee
*Assistant Examiner*—Jacob Y. Choi
(74) *Attorney, Agent, or Firm*—Thompson Coburn LLP

(57) ABSTRACT

A device and method for illuminating optical storage disks are disclosed. The device and method allow such disks to serve decorative and functional purposes, other than simply serving to store and transmit digital data. The display device is ideally suited to serve as a nightlight for children, and can also be utilized as an advertisement tool to promote the sale of optical storage disks or for any other suitable purpose.

15 Claims, 6 Drawing Sheets

DISPLAY DEVICE FOR ILLUMINATING OPTICAL STORAGE DISKS FOR VISUAL DISPLAY AND METHOD OF USING THE SAME

BACKGROUND OF THE INVENTION

Optical storage disks such as compact disks and digital video disks have become common place in most homes. Moreover, although newer technology has displaced portions of the market for optical storage disks, optical storage disks will likely remain in widespread use for years to come. This is especially likely in view of optical storage disks being a preferred tool for use in archiving data due to the permanent manner in which such disks store data.

While optical storage disks are provided in blank form with no indicia thereon, it has become increasingly common for optical storage disks to comprise text, graphics, or other visually perceivable indicia screen-printed or otherwise formed on one of the planar surfaces of such disks. This indicia may serve to simply identify and differentiate any given disk from another, or may also serve as a marketing tool by making a disk visually more attractive. For example, movies producers often print elaborate color graphics, similar to those appearing on marquee posters, directly on digital video disks containing their movies. Additionally, with album covers being a thing of the past, and with it being common store numerous optical storage disks together without individual cases, graphics or other indicia printed on such disks often serve to differentiate such disks from each other and serve the same function as the album covers of the past.

The inventor of the present invention has developed a new and practical way of utilizing the interesting and attractive indicia printed on optical storage disks. This new and practical way of utilizing such indicia is herein described and explained in the follow sections of this specification.

SUMMARY OF THE INVENTION

In general, the inventor of the present invention conceived of a device for illuminating optical storage disks to allow such disks to serve decorative and functional purposes, other than simply serving to store and transmit digital data. The display device is ideally suited to serve as a nightlight for children, and can also be utilized as an advertisement tool to promote the sale of optical storage disks or for any other suitable purpose.

In one aspect of the invention, a display device comprises a stem portion. The stem portion comprises at least a portion of at least one light emitting element. The display device is adapted and configured to removably engage with an optical storage disk. As is well known, such optical storage disks have opposite first and second planer surfaces and a central opening that extends through the optical storage disk from the first surface to the second surface. The stem portion of the display device is adapted and configured to extend through the central opening of the optical storage disk when the optical storage disk is engaged with the display device. Additionally, the portion of the at least one light emitting element is adapted and configured to illuminate at least a majority of the first surface of the optical storage disk when the optical storage disk is engaged with the display device and is also configured and adapted to pass through the opening of the optical storage disk.

In another aspect of the invention, a method comprises steps of providing an optical storage disk, providing a display device, engaging the optical storage disk with the display device, and illuminating indicia on a surface of the optical storage disk. The optical storage disk has opposite planer surfaces, at least one of which surfaces has indicia thereon. The display device comprises at least one light emitting element and first and second portions. The first portion of the display device is resiliently deflectable relative to the second portion of the display device. The step of engaging the optical storage disk with the display device occurs by resiliently deflecting the first portion of the display device relative to the second portion of the display device. Additionally, the step of illuminating the indicia on the first surface of the optical storage disk is performed via the light emitting element when the optical storage disk is engaged with the display device, and is performed in a manner such that light emitted from the at least one light emitting element is reflected off of the indicia and is viewable by an unaided human eye from a distance of at least five feet.

In yet another aspect of the invention, a method comprises a step of promoting the distribution of a product. The distribution of the product may be through sales of the product itself or may be some other form of distribution, such as a giveaway of the product to promote other goods or services. The step of promoting the distribution of the product is performed by presenting the product as being capable of engaging with an optical storage disk, and by presenting the product as being capable of illuminating the optical storage disk when the optical storage disk is engaged with the product for the purpose of visually displaying the optical storage disk.

While the principal advantages and features of the invention have been described above, a more complete and thorough understanding of the invention may be obtained by referring to the drawings and the detailed description of the preferred embodiment, which follow.

Figure 1:
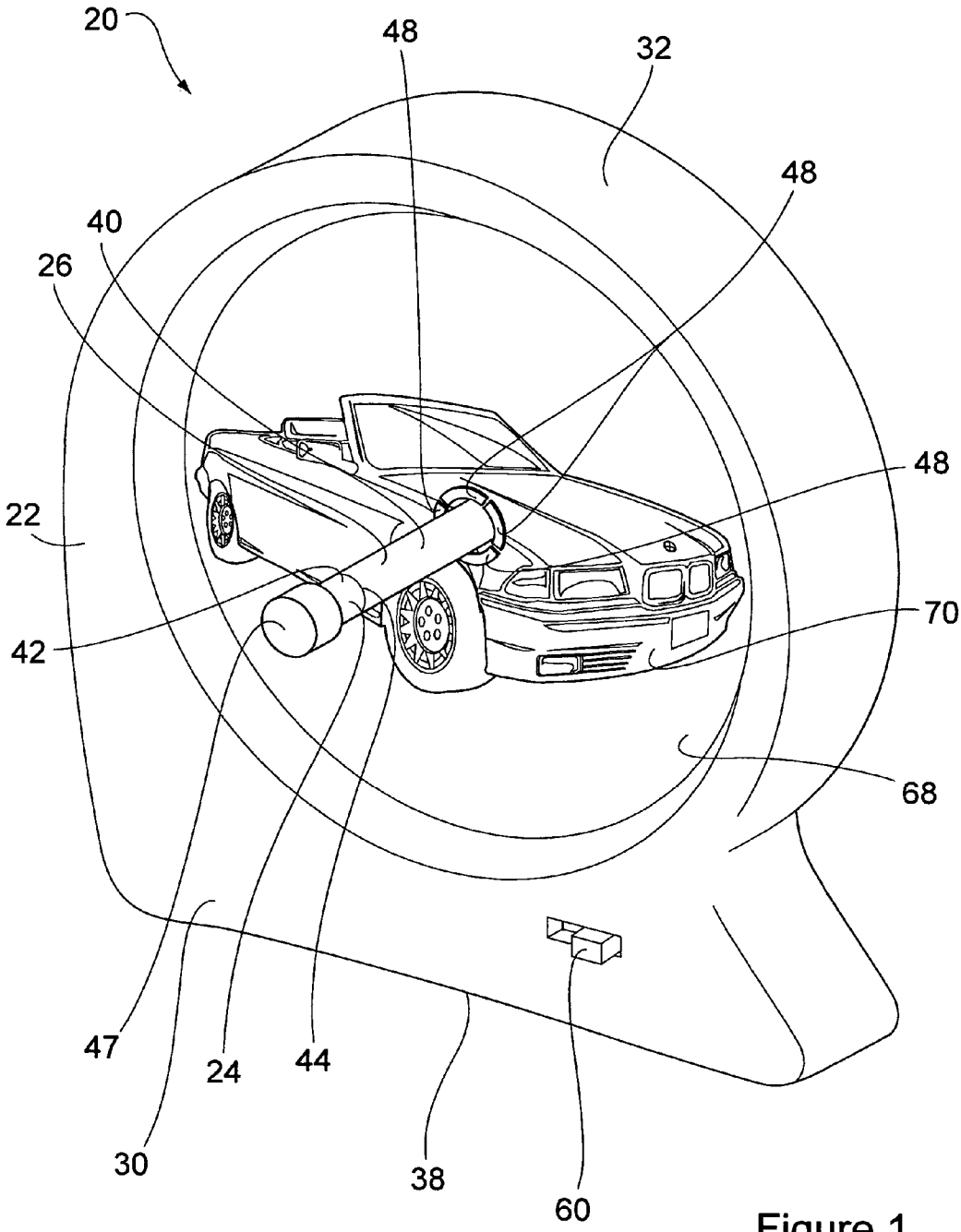
FIG. 1 is perspective view of a first embodiment of a display device in accordance with the invention and is shown with an optical storage disk attached thereto.
Figure 2:
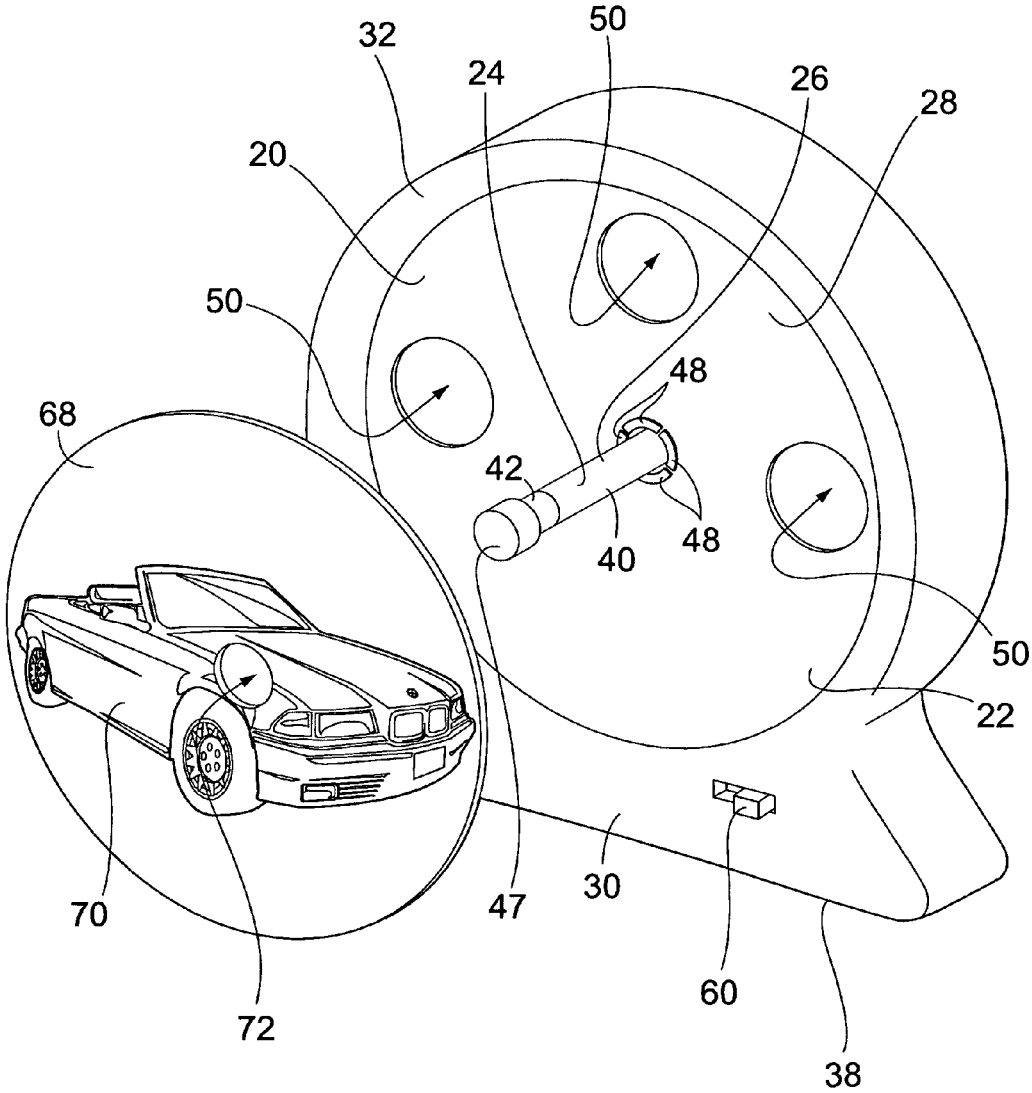
FIG. 2 is perspective view of the display device shown in FIG. 1 and is shown with the optical storage disk detached therefrom.
Figure 3:
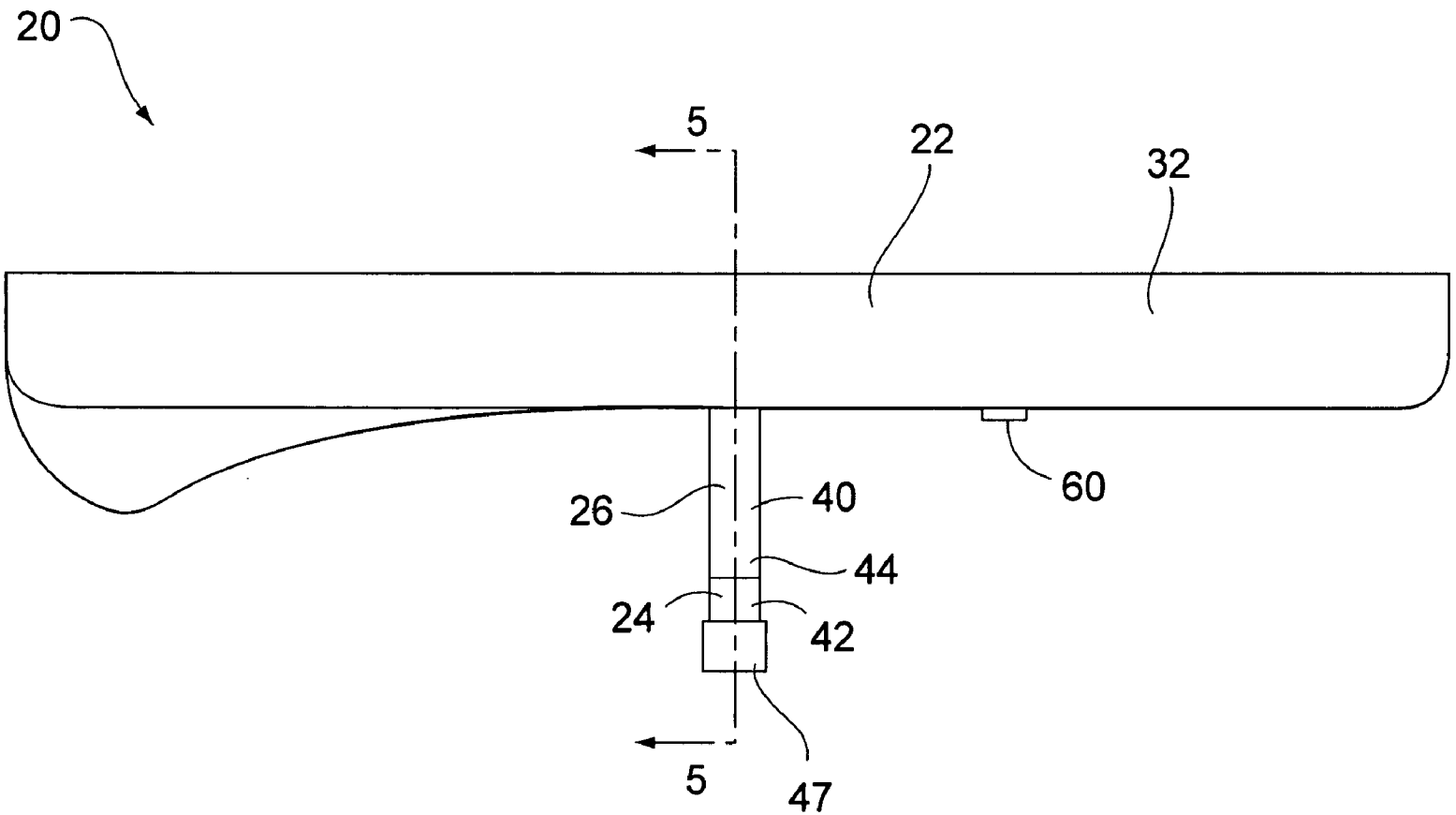
FIG. 3 is top view of the display device shown in FIGS. 1 and 2.
Figure 4:
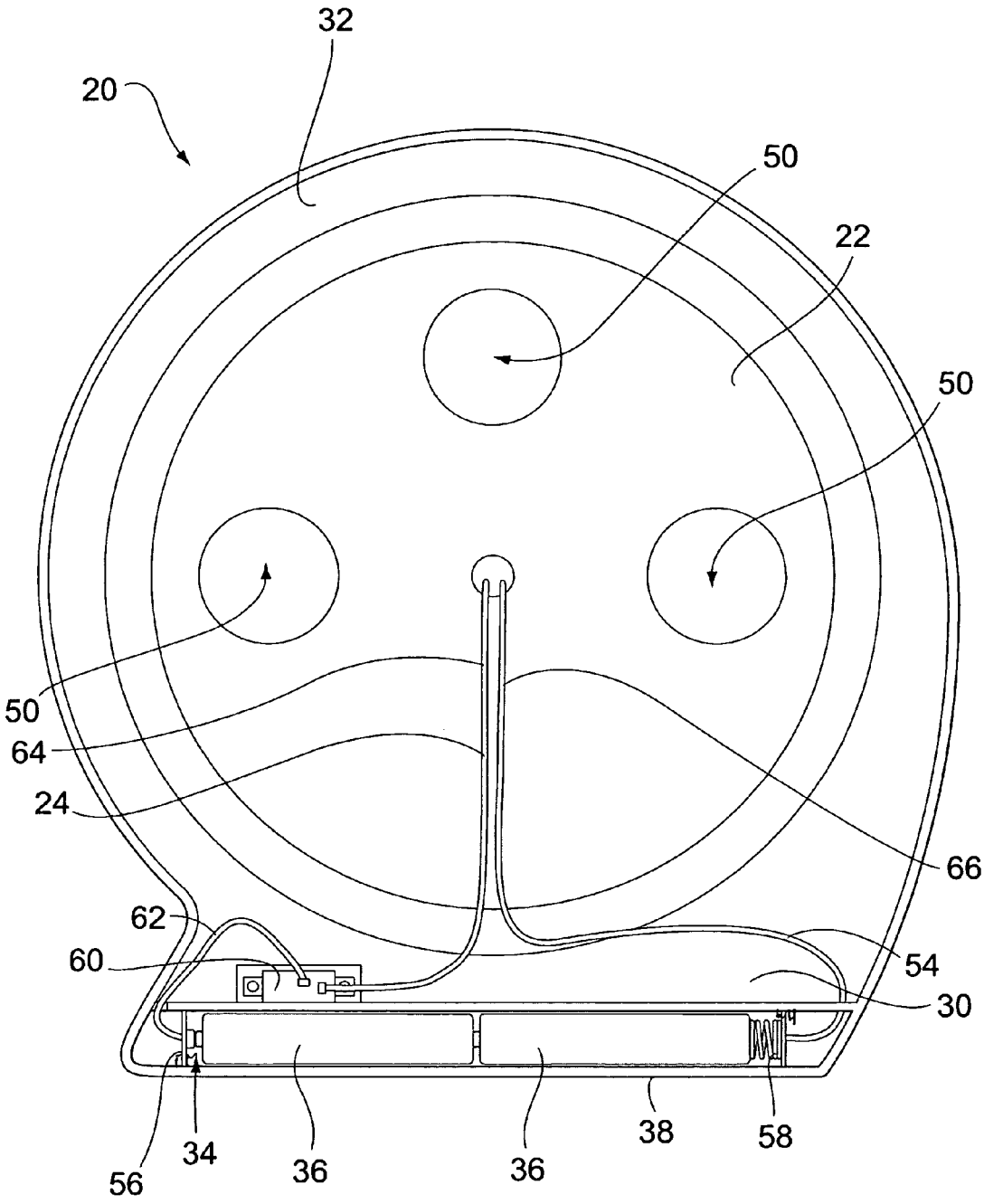
FIG. 4 is a rear elevation view of the display device shown in FIGS. 1–3.
Figure 5:
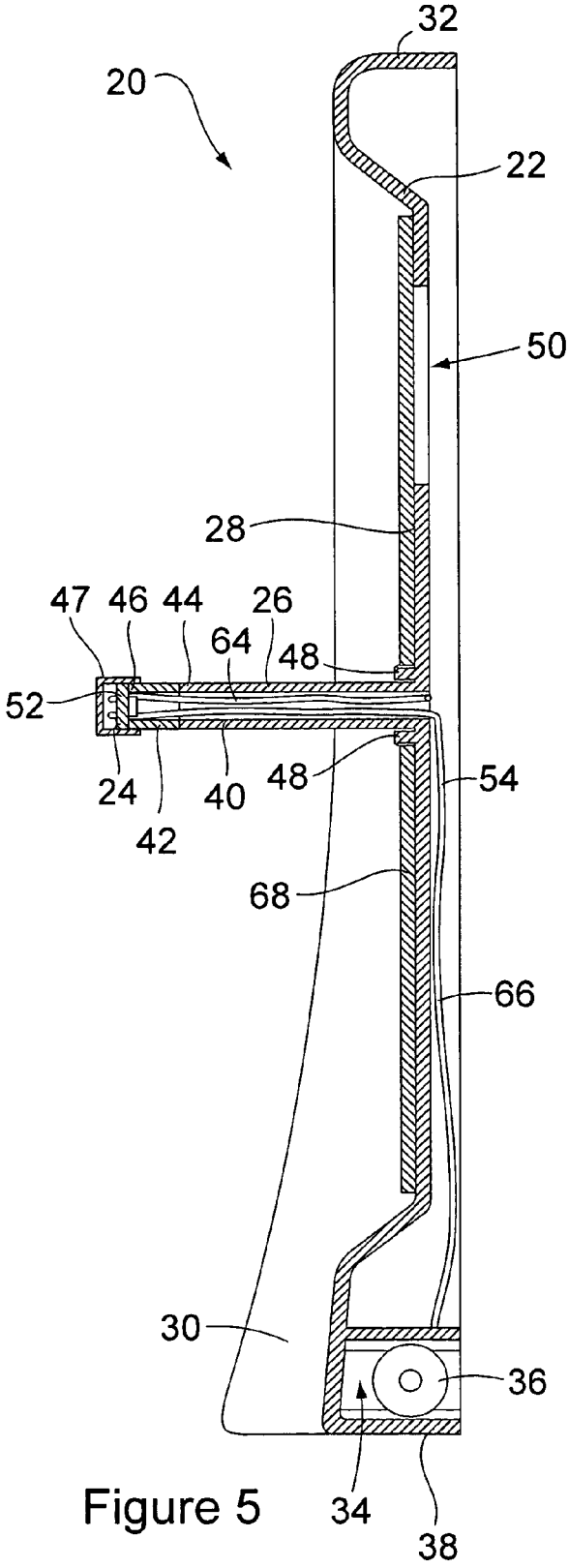
FIG. 5 is a cross-sectional elevation view of the display device shown in FIGS. 1–4 and is taken about the line 5—5 shown in FIG. 3.
Figure 6:
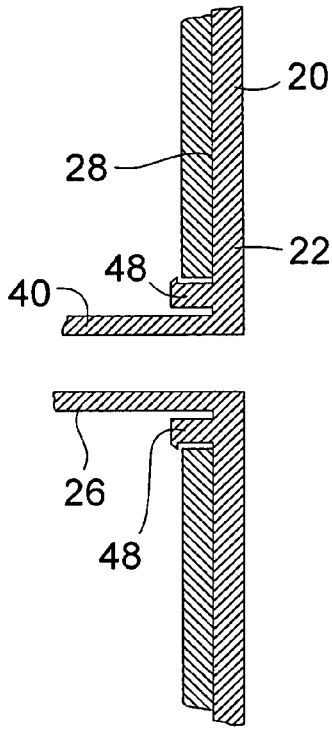
FIG. 6 is a detail view of the cross-sectional view of FIG. 5 showing a close-up view of the tines of the display device that are used to secure an optical storage disk to the device.

Reference characters in the written specification indicate corresponding items shown throughout the drawing figures.

DETAILED DESCRIPTION OF THE PREFERRED EMBODIMENTS OF THE INVENTION

A first embodiment of a display device in accordance with the invention is shown in FIGS. 1–6, and is generally indicated by reference numeral 20. In general, the display device 20 comprises a main body 22 and an illumination system 24.

The main body 22 of the display device 20 is preferably formed as a monolithic piece of plastic and preferably comprises a stem 26, a generally flat circular surface 28, a base portion 30, and a semi-annular rim portion 32. The circular surface 28 of the main body 22 preferably has a diameter slightly larger than a standard one-hundred and twenty millimeter diameter compact disk. The base portion 30 preferably comprises an interior cavity 34 that is shaped receive and support a pair of standard AA-sized batteries 36, and a flat bottom surface 38. The rim portion 32 preferably protrudes forward from and partially around the circular surface 28 of the main body 22, and preferably blends smoothly into the base portion 30. The stem 26 preferably comprises a first cylindrical tube-shaped portion 40 that is integrally formed with the main body 22 and that protrudes perpendicularly outward from the center of the circular surface 28. The stem also preferably comprises a second cylindrical tube-shaped portion 42 that is axially aligned with the first tube-shaped portion 40 and that extends from the terminal end portion 44 of the first tube-shaped portion 40. The second tube-shaped portion 42 of the stem 26 preferably has the same diameter as the first tube-shaped portion 40 and is made of substantially transparent material. The second tube-shaped portion 42 is preferably bonded to the first tube-shaped portion 40. Alternatively, the second tube-shaped portion 42 and the first tube-shaped portion 40 can be configured to have interlocking geometry that allows such portions of the stem 26 to be snap-fit together. Still further, the stem 26 preferably comprises a cap 47 that extends around and closes the terminal end portion 46 of the second tube-shaped portion 42.

In addition to the above-mentioned components, the main body 22 of the display device 20 preferably comprises a plurality of resiliently deflectable tines 48 and a plurality of access openings 50. The tines 48 extend from the circular surface 28 and preferably are circumferentially spaced from each other around the stem 26. The tines 48 are similar in form and function to the resiliently deflectable tines of a standard jewel case of the type used to store compact disks and digital video disks. More particularly, the tines 48 are shaped and configured to engage with the standard fifteen millimeter opening that extends through a compact disk or other optical storage disk in a manner such that the optical storage disk can be removably secured to the display device 20. The access openings 50 are preferably cylindrical and extend through main body 22 and the circular surface 28 thereof.

The illumination system 24 of the display device 20 preferably comprises a light emitting diode 52, a plurality of electrically conductive wires 54, the pair of batteries 36, a contact plate 56, a compression spring 58, and a manually operated single-pole electrical switch 60. The phrase "light emitting diode" (hereafter LED) as used herein should be interpreted broadly to encompass standard LEDs as well as the emitters that that often form only a portion of an LED. The LED 52 of the illumination system 24 is preferably a one watt Luxeon® Emitter produced by Lumileds Lighting U.S., LLC., which is configured to emit a one-hundred and ten degree conical beam of light. The LED 52 is preferably positioned adjacent the terminal end portion 46 of the second tube-shaped portion 42 of the stem 26, and within the cap 47, in a manner such that the LED is oriented to emit light toward the circular surface 28 of the main body 22. The electrical switch 60 is positioned partially within the base portion 30 of the main body 22 of the display device 20. The compression spring 58 and the contact plate 56 are positioned within the interior cavity 34 of the base portion 30 and are positioned such that the batteries 36 are biased to each other in series and to the contact plate 56 by the compression spring 58. Preferably, the compression spring 58 engages the negative terminal of the batteries 36 and the contact plate engages the positive terminal of the batteries. A first 62 one of the wires 54 preferably electrically connects the contact plate 56 to a first terminal of the electrical switch 60. A second 64 one of the wires 54 preferably electrically connects the other terminal of the switch to a terminal of the LED 52 by passing through the center of the stem 26. A third 66 one of the wires 54 preferably passes through the center of the stem 26 and electrically connects the other terminal of the LED 52 to the compression spring 58. Configured in this manner, the batteries 36 are able to supply power to the LED 52 and the switch 60 is capable of opening and closing the circuit so as to turn the LED on and off.

In use, the bottom surface 38 of the base portion 30 of the display device 20 can be placed on a horizontal surface in manner such that the display device is supported by the horizontal surface with its circular surface 28 oriented in a generally vertical manner. Additionally, an optical storage disk 68 can be attached to and supported by the display device 20 by passing the stem 26 of the display device through the center opening 72 of the disk. During the attachment of the disk 68 to the display device 20, the center opening 72 of the disk engages with the tines 48 of the display device. The tines 48 are configured and adapted to resiliently deflect radially inward as they engage with the disk 68 and thereby releasably secure the disk to the display device 20 via a frictional force. This prevents the optical storage disk 68 from becoming dislodged from the display device 20 without applying a threshold separating force therebetween. Preferably, the disk 68 is attached to the display device 20 in a manner such that the reward flat surface of the disk (the side without visually pleasing indicia) engages against the circular surface 28 of the display device.

With an optical storage disk 68 attached to the display device 20 as described above and as shown in FIG. 1, a person can then utilize the illumination system 24 of the display device to illuminate the indicia 70 on the forward flat surface of the disk. This is done by simply switching the electrical switch 60 in a manner to close the circuit between the batteries 36 and the LED 52. The light emitted from the LED 52 is directed toward the forward face of the optical storage disk 68 and passes through the transparent second tube-shaped portion 42 of the stem 26 of the display device 20. The stem 26 is preferably dimensioned such that the LED 52 is positioned in a manner such that the one-hundred and ten degree conical beam of light emitted from the LED illuminates the entire forward face of the disk 68 without also directly illuminating the rim portion 32 or the base portion 30 of the display device 20. When desired, the electrical switch 60 of the display device 20 can be switched in a manner to open the electrical circuit and thereby turn off the LED 52.

At any desired time, the optical storage disk 68 can be removed from the display device 20 and can be replaced by another optical storage disk to thereby change the display illuminated by the display device. This is preferably done by simply inserting one or more fingers through the access openings that extend through the circular surface 28 of the display device 20 from the rear of the display device, and by pressing on the rearward flat surface of the optical storage disk 68 with the threshold separating force sufficient to overcome the frictional force generated by the resiliently deflected tines 48 of the display device. After removing the optical storage disk 68 from the display device 20, another disk can be attached to the display device in same manner as the previous disk was attached to the display device.

In view of the foregoing, it should be appreciated that the display device 20 can placed on a table, shelf, or any other suitable object having a generally flat horizontal surface. Alternatively, it should also be appreciated that the display device can be adapted and configured to be suspended from a wall or other vertical surface by a nail, a magnet, or by other suitable means. Additionally, it should be appreciated that the display device can serve as a nightlight or as a means for decorating a room by displaying a graphic image or other indicia on a optical storage disk in a an illuminated manner. Still further, the display device 20 can be used to promote the sale of optical storage disks by displaying a sample of such disks in an attractive and eye-catching manner. It is also envisioned that the display devices 20 may be distributed as gift items for promoting other goods or services. Preferably, the display device is packaged in packaging that contains indicia that explains or illustrates the use of the display device to support and illuminate optical storage disks.

Figure 7:
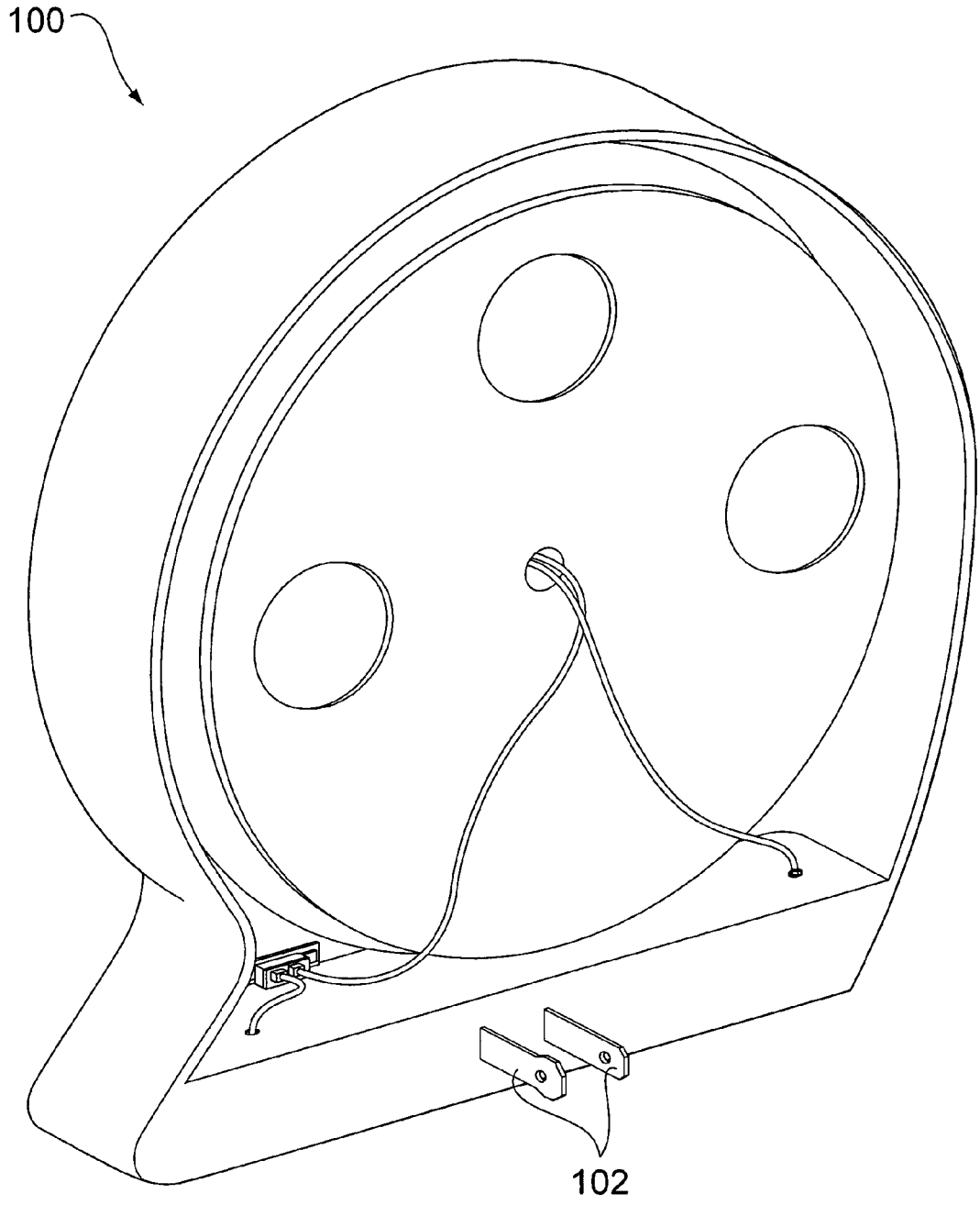
FIG. 7 is a perspective view of a second embodiment of a display device in accordance with the invention showing the rear side of the display device.

A second embodiment of a display device 100 in accordance with the invention is shown in FIG. 7. This display device 100 is essentially identical to the embodiment of the display device 20 previously described, with a few differences. In particular, the display device 100 shown in FIG. 7 has a pair of electrically conductive tines 102 configured as a standard male fitting for connection to a standard electrical outlet. Thus, it should be appreciated that this display device 100 does not need batteries and that the internal cavity of the base portion of the display device can house a rectifier, resistors, or other electrical components that may make up portions of the illumination system of the display device and that adapt the illumination system for use in connection with alternating current supplied by a standard electrical outlet. As such, it should be appreciated that this embodiment of a display device 100 is suited to be supported from and powered by a standard electrical outlet.

While the present invention has been described in reference to specific embodiments, in light of the foregoing, it should be understood that all matter contained in the above description or shown in the accompanying drawings is intended to be interpreted as illustrative and not in a limiting sense and that various modifications and variations of the invention may be constructed without departing from the scope of the invention defined by the following claims. For example, a display device could be configured without a stem portion and have one or more light emitting elements positioned around the perimeter of an optical storage disk attached thereto. Additionally, a display device in accordance with the invention needs not necessarily have a means for securing an optical storage disk thereto and, instead, could merely support such an optical storage disk. Still further, it should be appreciated that the light emitting element does not have to produce light itself. For example, the stem of a display device could take the form of a molded piece of transparent plastic that is formed to serve as a conduit for light and to evenly disperse such light. In such a display device, the light source could be a bulb, LED, or the like positioned elsewhere on the device and that is configured to transmit light into the molded piece of transparent plastic. Further more, power for illumination could be provided by a standard plug and cord, either with or without a transformer. Additionally, a display device in accordance with the invention could be configured to support and illuminate two or more optical storage disks positioned side-by-side or facing opposite directions. Still further, the source of illumination could comprise or consist of electroluminescence material. Thus, other possible variations and modifications should be appreciated.

Furthermore, it should be understood that when introducing elements of the present invention in the claims or in the above description of the preferred embodiment of the invention, the terms "comprising," "including," and "having" are intended to be open-ended and mean that there may be additional elements other than the listed elements. Similarly, the term "portion" should be construed as meaning some or all of the item or element that it qualifies.

What is claimed is:

1. An assembly comprising:

an optical storage disk having a forward facing planar surface, a rearward facing planar surface, and a central opening that extends through the optical storage disk from the forward facing planar surface to the rearward facing planar surface, the central opening having a diameter; and a display device removably engaged with the optical storage disk, the display device having a stem portion, the stem portion comprising at least a portion of at least one light emitting element, the stem portion of the display device extending through the central opening of the optical storage disk in a manner supporting the portion of the at least one light emitting element forward of the forward facing planar surface of the optical storage disk, the stem portion having a maximum cross-sectional dimension in all cross-sections of the stem portion parallel to and forward of the forward facing planar surface of the optical storage disk, the maximum cross-sectional dimension being at most equal to the diameter of the central opening of the optical storage disk, at least a majority of the forward facing planar surface of the optical storage disk being illuminated by the portion of the at least one light emitting element; a first and second portions, the first and second portions of the display device being engaged with the optical storage disk in a manner releasably securing the optical storage disk to the display device, the first portion being resiliently deflectable relative to the second portion in a manner such that the optical storage disk adapted to disengaged with an unattached to the display device, without disassembling any part of the display device.

2. An assembly in accordance with claim 1 wherein the first portion of the display device is engaged with the central opening of the optical storage disk in the manner releasably securing the optical storage disk to the display device.

3. An assembly in accordance with claim 1 wherein the at least one light emitting element is at least one light emitting diode.

4. An assembly in accordance with claim 1 further comprising a power source that is operatively connected to the light emitting element.

5. An assembly in accordance with claim 4 wherein the power source comprises a battery.

6. An assembly in accordance with claim 1 wherein the display device is adapted and configured to rest on a horizontal surface and to support the optical storage disk in a manner such that the forward facing planer surface of the optical storage disk is oriented more than forty-five degrees relative to the horizontal surface when display device is resting on the horizontal surface.

7. A method comprising:

providing an optical storage disk, the optical storage disk having opposite planer surfaces and a central opening, at least one of the surfaces of the optical storage disk having indicia thereon, the central opening extending through the optical storage disk from the one of the planer surfaces to the other of the planer surfaces;

providing a display device, the display device comprising at least one light emitting element and first and second portions, the first portion of the display device being resiliently deflectable relative to the second portion of the display device;

engaging the optical storage disk with the display device by resiliently deflecting the first portion of the display device relative to the second portion of the display device and by passing the at least one light emitting element through the central opening of the optical storage disk;

illuminating the indicia on the first surface of the optical storage disk via the at least one light emitting element when the optical storage disk is engaged with the display device in a manner such that light emitted from the at least one light emitting element is reflected off of the indicia and is viewable by an unaided human eye from a distance of at least five feet; and removing the optical storage device from the display device after performing the above-recited steps and without disassembling any part of the display device.

8. A method in accordance with claim 7 wherein the step of illuminating the indicia on the first surface of the optical storage disk comprises emitting light from the at least one light emitting element from a point that is located on an axis that is perpendicular to the planer surfaces of the optical storage disk and that passes through the central opening of the optical storage disk.

9. A method in accordance with claim 7 wherein the step of providing the display device occurs in a manner such that the display device comprises at least one light emitting diode.

10. A method in accordance with claim 7 wherein the step of providing the optical storage disk occurs in a manner such that the central opening is defined by a cylindrical surface, and wherein the step of engaging the optical storage disk with the display device comprises resiliently deflecting the first portion of the display device relative to the second portion of the display device by engaging the first portion of the display device with the cylindrical surface of the display device.

11. A method in accordance with claim 7 wherein the step of providing the display device occurs in a manner such that the display device comprises a power source and wherein the step of illuminating the indicia on the first surface of the optical storage disk via the at least one light emitting element comprises utilizing the power source to generate the light emitted from the at least one light emitting element.

12. A method in accordance with claim 11 wherein the step of providing the display device occurs in a manner such that the power source is a battery.

13. A method in accordance with claim 7 wherein the step of providing the display device occurs in a manner such that the display device comprises an manually operable electrical switch that is operatively connected to the light emitting element and wherein the method further comprises a step of utilizing the electrical switch to prevent light from being emitted from the at least one light emitting element.

14. A method in accordance with claim 7 wherein the step of providing the optical storage disk occurs in a manner such that the optical storage disk is a digital video disk.

15. A method in accordance with claim 7 wherein the step of providing the optical storage disk occurs in a manner such that the optical storage disk comprises digital data stored thereon.

* * * * *